US007373712B2

(12) United States Patent
Kuo et al.

(10) Patent No.: US 7,373,712 B2
(45) Date of Patent: May 20, 2008

(54) METHOD FOR MAKING AN ANTENNA STRUCTURE

(75) Inventors: Steven Szu-Cherng Kuo, Torrance, CA (US); Andrew Lee Roberts, Newhall, CA (US); James David Ingram, Seal Beach, CA (US); Imants Eglitis, Torrance, CA (US); Henry Chang, Palos Verdes, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 345 days.

(21) Appl. No.: 10/884,107

(22) Filed: Jul. 2, 2004

(65) Prior Publication Data

US 2005/0237239 A1 Oct. 27, 2005

Related U.S. Application Data

(60) Provisional application No. 60/564,323, filed on Apr. 22, 2004.

(51) Int. Cl.
*H01P 11/00* (2006.01)

(52) U.S. Cl. ..... 29/600; 29/601; 343/786

(58) Field of Classification Search ..... 29/600, 29/601, 602.1, 593, 825, 832; 343/700 MS, 343/895, 795, 756, 789, 909, 906, 898; 340/572.7; 235/492; 333/21 A, 157

See application file for complete search history.

(56) References Cited

U.S. PATENT DOCUMENTS

| | | | | |
|---|---|---|---|---|
| 3,821,741 | A * | 6/1974 | D'Oro et al. | 342/358 |
| 4,731,616 | A * | 3/1988 | Fulton et al. | 343/786 |
| 4,757,324 | A * | 7/1988 | Dhanjal | 343/776 |
| 4,797,681 | A * | 1/1989 | Kaplan et al. | 343/786 |
| 4,903,038 | A * | 2/1990 | Massey | 343/786 |
| 6,137,450 | A * | 10/2000 | Bhattacharyya et al. | 343/786 |
| 6,924,775 | B2 * | 8/2005 | Suga | 343/786 |
| 7,034,774 | B2 * | 4/2006 | Kuo et al. | 343/909 |

OTHER PUBLICATIONS

S.J. Orfanidis "*Aperture Antennas*"; Electromagnetic Waves & Antennas; Feb. 28, 2004; pp. 575-619.

* cited by examiner

*Primary Examiner*—Minh Trinh
(74) *Attorney, Agent, or Firm*—Tarolli, Sundheim, Covell & Tummino LLP

(57) ABSTRACT

A method for making a feed structure for an antenna may include providing a polarizer body having a polarizer sidewall extending longitudinally between spaced apart ends. A portion of the polarizer sidewall is deformed to provide at least one polarizing structure that extends radially inwardly along an interior of the polarizer sidewall relative to adjacent portions of the polarizer sidewall. The method thus can be utilized to produce an antenna structure.

8 Claims, 7 Drawing Sheets

METHOD FOR MAKING AN ANTENNA STRUCTURE

CROSS REFERENCE TO RELATED APPLICATIONS

This application claims the benefit of provisional patent application No. 60/564,323, which was filed on Apr. 22, 2004, and is entitled ANTENNA STRUCTURE AND METHOD OF MAKING ANTENNA STRUCTURE, and this application is related to U.S. patent application Ser. No. 10/883,876, which was filed on Jul. 2, 2004, and is entitled FEED STRUCTURE AND ANTENNA STRUCTURES INCORPORATING SUCH FEED STRUCTURES, both of which applications are incorporated herein by reference.

TECHNICAL FIELD

The present invention relates generally to antennas and, more particularly, to a method and system for making an antenna structure and to corresponding antenna structures.

BACKGROUND

A modern phased array (PA) antenna system typically requires hundreds, or thousands of radiating elements to form the antenna aperture. Thus, for a cost-effective PA system, a simple radiating element design is essential.

Typical processes employed in the manufacture of antennas include a combination of one or more of the following processes, hipping, electroforming, electroplating and machining. The selection of these processes can be tailored according to the particular design of the antenna structure being fabricated. For a typical antenna, more than one type of manufacturing process often may be needed, such as by employing different processes for making different parts of the antenna feed system. Since most antenna structures include various components that are attached together, such as by clamping, the manufacturing process also includes assembling the various components to provide the desired structure. In addition to the time and cost associated with assembling the various parts, the clamping mechanisms for attaching such parts also increases the weight of the resulting structure.

SUMMARY

The present invention relates a method and system for making an antenna structure and to corresponding antenna structures.

One aspect of the present invention provides a method for making a feed structure for an antenna. The method includes providing a polarizer body having a polarizer sidewall extending longitudinally between spaced apart ends. A portion of the polarizer sidewall is deformed to provide at least one polarizing structure that extends radially inwardly along an interior of the polarizer sidewall relative to adjacent portions of the polarizer sidewall. The method thus can be utilized to produce an antenna structure.

Another aspect of the present invention relates to a system to facilitate making an antenna structure. The system may include a mandrel insertable within a polarizer body, the mandrel including at least one female mandrel member dimensioned and configured to shape at least one corresponding polarizing structure in a sidewall of the polarizer body. A clamping system can be employed to urge the sidewall of the polarizer body into at least one female mandrel member to form the corresponding polarizing structure.

The systems and methods can be employed to facilitate fabrication of antenna structures.

DETAILED DESCRIPTION

Figure 1:
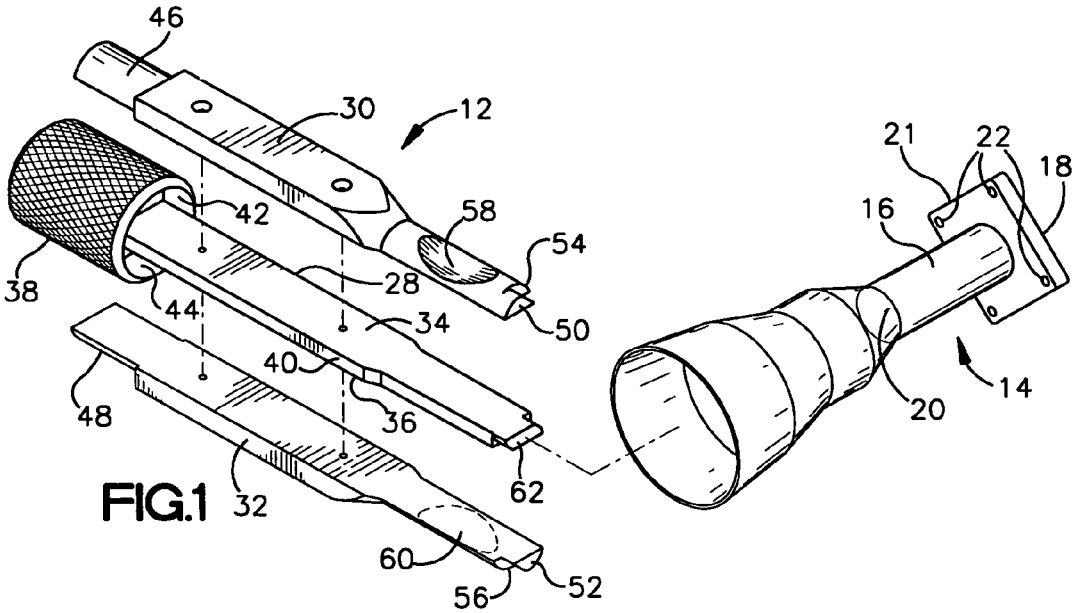
FIG. 1 depicts an assembly view of a pre-fabrication polarizer and an example of an internal mandrel according to an aspect of the present invention.

FIG. 1 depicts an assembly view of a multi-piece mandrel 12 and a work piece 14 from which a polarizer is to be fabricated according to an aspect of the present invention. The work piece 14 includes a generally cylindrical sidewall portion 16 extending longitudinally between spaced apart ends 18 and 20. For example, the distal end 18 can include a flange 21 that includes a plurality of apertures 22.

Figure 10:
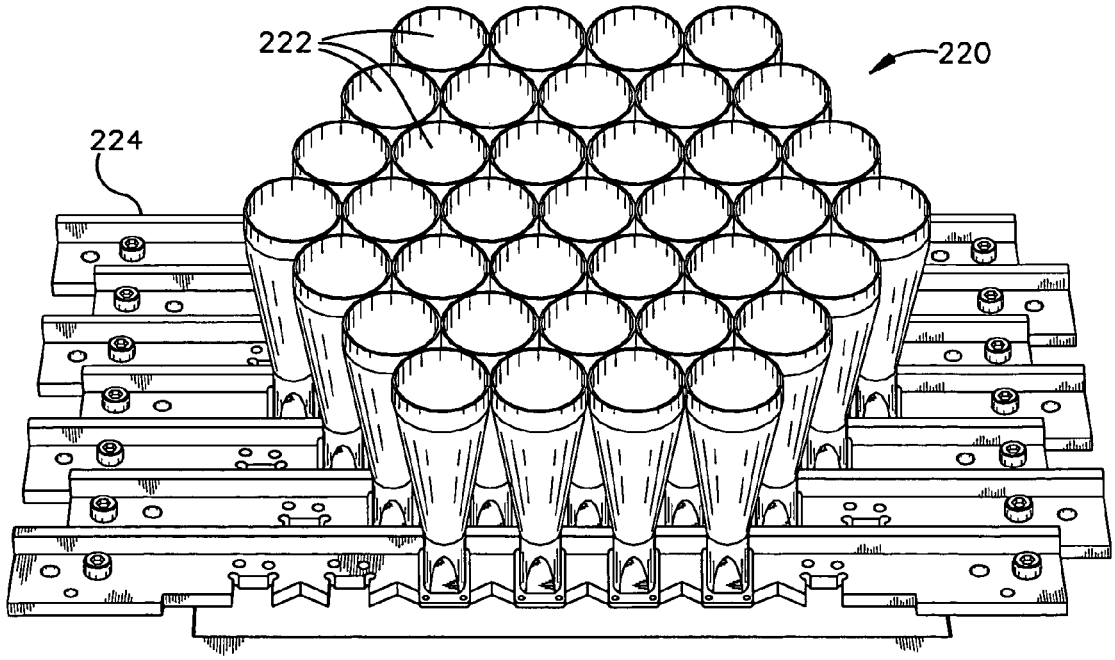
FIG. 10 depicts an example of a phased array antenna according to an aspect of the present invention.

The flange 21 and apertures 22 can be utilized for clamping the resulting antenna structure to a mounting plate (see, e.g., FIG. 10). A proximal end 20 of the work piece 14 can define the proximal end of a polarizer. The proximal end of the polarizer, for example, can be attached by suitable attachment means to a horn. Alternatively, the proximal end 20 of the work piece 14 can itself correspond to a horn, such as when the work piece 14 is being fabricated as an integrated horn antenna structure that includes both a polarizer and horn.

In the example of FIG. 1, the mandrel 12 includes three portions, namely, a middle portion 28 and a pair of opposed side mandrels 30 and 32. The mandrel 12 can be assembled by positioning the side mandrels 30 and 32 on opposed side surfaces 34 and 36 of the middle mandrel 28. The mandrel portions 28-32 can be fixed or be unsecured relative to each other. The middle mandrel portion 28 can include a knob or handle 38 that is attached to a proximal end thereof.

An elongate rod 40 extends longitudinally from the handle 38. The elongate rod 40 has the opposed side surfaces 34 and 36 for engaging the respective side mandrel portions 30 and 32 in the assembled condition. Additionally, corresponding receptacles 42 and 44 are formed in the handle 38. At a juncture between the respective side surfaces 34 and 36 and the handle 38, the receptacles 42 and 44 are dimensioned and configured for receiving corresponding end portions 46 and 48 of the respective side mandrels 30 and 32.

In the example of FIG. 1, the end portions 46 and 48 of the respective side mandrels 30 and 32 have semi-circular cross-sections dimensioned and configured to fit into the corresponding receptacles 42 and 44 between an interior sidewall of the handle 38 and the generally flat surfaces 34 and 36 of the middle mandrel. Other shapes and configuration could also be utilized. Each of the side mandrels 30 and 32 includes a corresponding distal end portion 50 and 52. The respective distal end portions 50 and 52 can be dimensioned and configured for mating with the corresponding internal structure, such as a transition, which can be formed within the respective work piece 14 near the distal end 18. For example, each of the respective end portions 50 and 52 also includes a corresponding notched shoulder 54 and 56 that, when assembled with the other parts of the mandrel 12, mates or fits with the transition that is formed within the interior of the work piece 14.

Each of the side mandrels 30 and 32 also includes female mandrel members 58 and 60. The respective female mandrel members 58 and 60 are recessed relative to the associated side surface of the mandrel extending between the respective ends. The particular shape of the female mandrel members can vary according to design considerations. In the example of FIG. 1, the female mandrel members 58 and 60 can be considered generally semi-torus or semi-ellipsoidal. That is, the female mandrels define receptacles having a dual radii cross-section dimensioned and configured for shaping a sidewall of the work piece 14 in response to urging male mandrel members (not shown) radially inwardly relative to the female mandrel members 58 and 60. While the particular examples shown in FIG. 1 and elsewhere in this description correspond to a substantially smooth curved contour, the female mandrel members 58 and 60 are not limit to such configurations. For instance, the surfaces could include discontinuities, such as corrugations or protrusions. Additionally or alternatively, the female mandrel members 58 and 60 could be implemented in other shapes to provide desired polarization of electromagnetic waves propagating therethrough.

Figure 2:
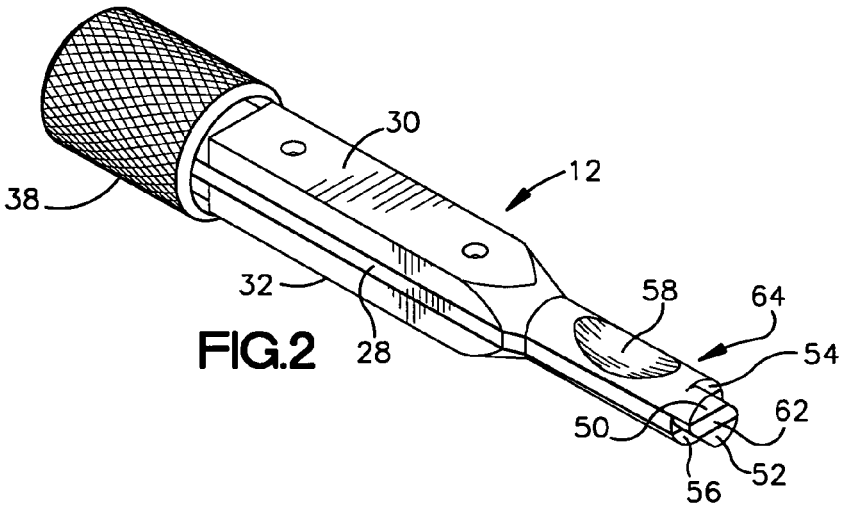
FIG. 2 depicts an example of a multi-piece mandrel according to an aspect of the present invention.

FIG. 2 depicts an example of the mandrel 12 in an assembled position in which the respective side mandrels 30 and 32 sandwich the middle mandrel 28. As depicted in FIG. 2, the female mandrel member 58 of the side mandrel 30 is formed near the distal end thereof and axially spaced apart from the distal end 50. A distal end 62 of the middle mandrel 28, and the distal ends 50 and 52 of the respective side mandrels 30 and 32 are substantially flush. The protruding part of the distal end 62 of the middle mandrel 28 is configured for insertion within a corresponding part (e.g., a slot or bore hole) of a transition formed in the polarizer. That is, the respective distal ends 50 and 52 and notched shoulders 54 and 56 of the corresponding side mandrels 30 and 32 collectively with the protruding distal end portion 62 of the middle mandrel 28 are dimensioned and configured for seating into a step of a transition near a base within the work piece 14. The distal end portion 64 of the assembled mandrel 12 can have a substantially circular cross-section (or other configuration) for insertion within a corresponding circular sidewall of a polarizer, such as shown in FIG. 3.

Figure 3:
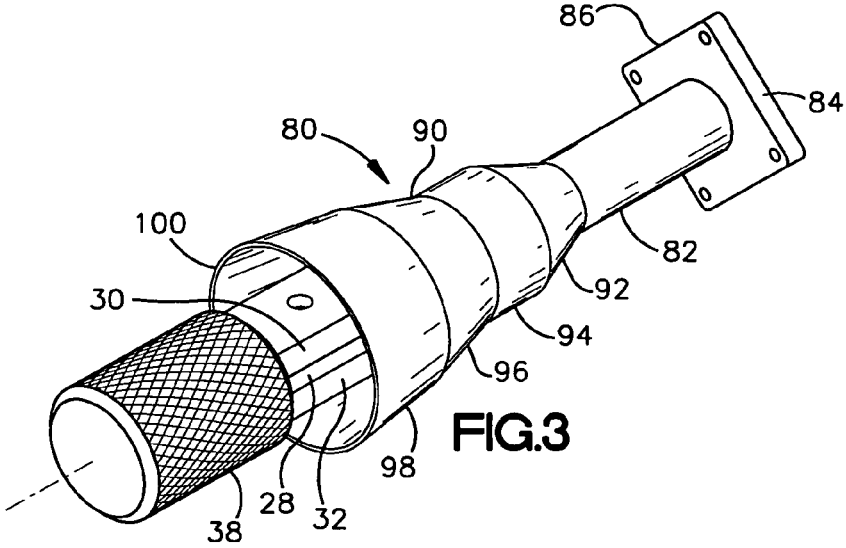
FIG. 3 depicts an example of the mandrel of FIG. 2 inserted within a horn-polarizer assembly according to an aspect of the present invention.

For instance, in the example of FIG. 3, the assembled mandrel system 12 is inserted within a horn antenna structure 80. The antenna structure 80 includes a distal end portion defined by a polarizer 82 having a corresponding base portion 84 that includes a flange 86. The flange is formed at the distal end of the polarizer 82. A transition (e.g., a step transition) has been formed by machining or other processing methods, near the base portion 84 of the antenna structure 80. As described herein, those skilled in the art will understand and appreciate that various transition structures can be utilized to provide a suitable interface between a waveguide and the polarizer 82.

In the example of FIG. 3, the antenna structure 80 includes a horn 90 extending axially from the polarizer 82. The horn 90 can be formed as an integral structure with the polarizer transition 82, such as shown in FIG. 3. Alternatively, as described herein, a suitable horn can be attached at a proximal end of the polarizer 82 by suitable attachment means. Since, according to an aspect of the present invention, the distal end of the mandrel 12 is dimensioned and configured for mating with a corresponding transition formed near the base 84 of the polarizer 82, the female mandrel members 58 and 60 are oriented at a desired angular position relative to the orientation of the step transition. The angular orientation of the female mandrel members 58 and 60 can be selected to provide desired polarization for the resulting antenna.

For the example of circular polarization, the polarizer 82 can be configured for radiating a circularly polarized electromagnetic field (e.g., right hand circular polarization (RHCP) as well as left handed circular polarization (LHCP)). Thus, the polarizer 82 can be fabricated to achieve predetermined polarization having a desired axial ratio (AR), which is a ratio of RHCP and LHCP. For instance, the AR can be customized by employing the female mandrel members 58 and 60 to form corresponding polarizing structures at suitable angular positions within the polarizer. A generally circular conical horn configuration, as depicted in FIG. 3, facilitates providing circular polarization, which is desirable for many antenna applications.

Figure 4:
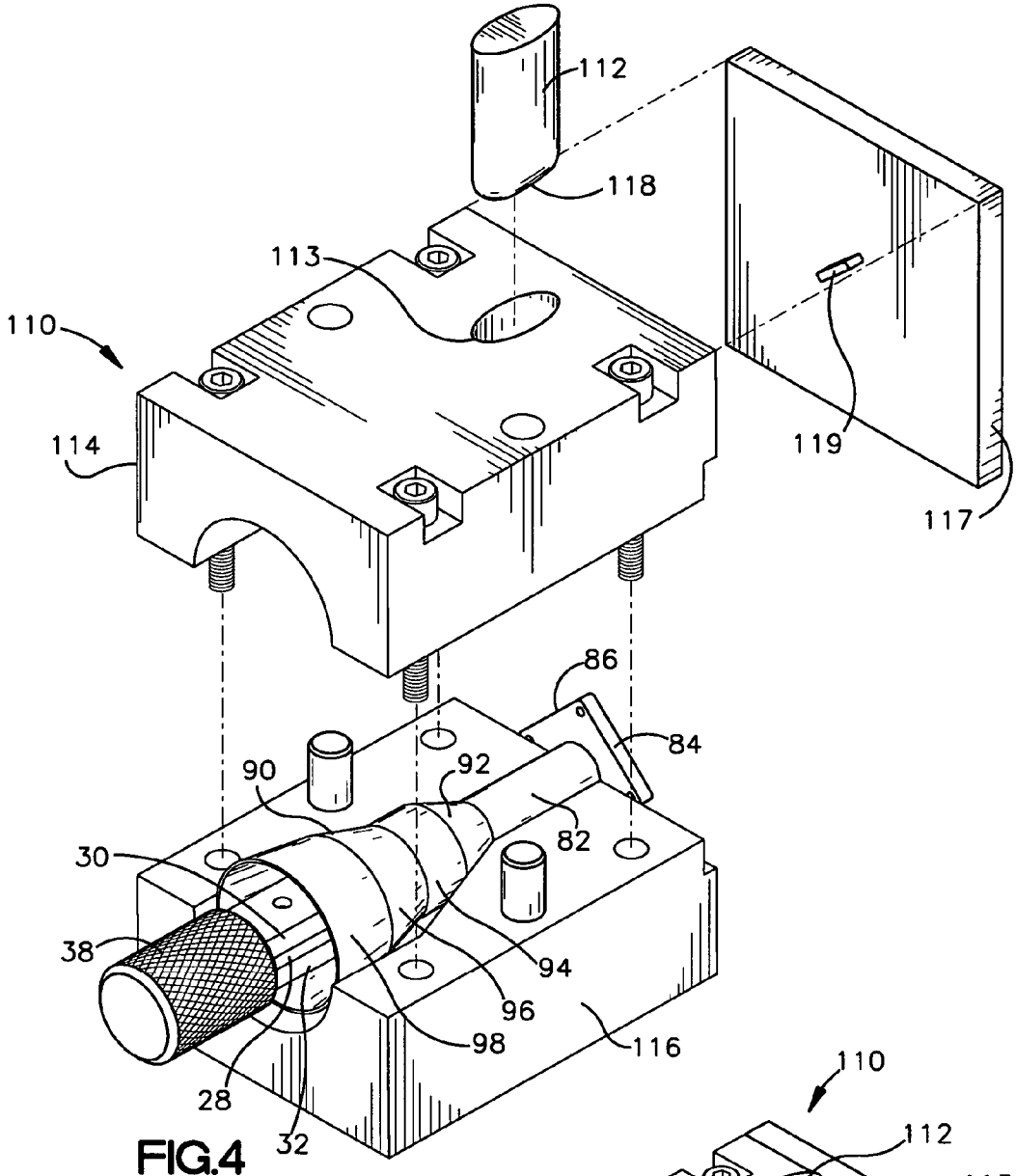
FIG. 4 depicts an example of the mandrel/horn assembly within a clamping system according to an aspect of the present invention.

After the mandrel 12 has been properly inserted within the antenna structure 80, the mandrel/antenna assembly 12, 80 can be inserted into a corresponding clamping system 110, such as shown in FIG. 4. In the example of FIG. 4, the clamping system 110 has an interior chamber dimensioned and configured for receiving the mandrel/antenna assembly 12, 80. The clamping system 110 also includes one or more male mandrel members 112 that are movable relative to the polarizer to form polarizing structures in a sidewall portion thereof. For example, the male mandrel members 112 are movable within apertures 113 extending through of corresponding sides of a split block 114 and 116. Alternative means could be provided to guide the male mandrel members accordingly. The male mandrel members 112 include inwardly facing surfaces 118 dimensioned and configured for mating with the corresponding female mandrel members 58 and 60 positioned within the antenna structure 80. For example, the inwardly facing surfaces 118 of the male mandrel members 112 can be convex, such as having dual radii or other shape corresponding to the dimensions and configurations of the female mandrel members 58 and 60. An end cap 117 attaches to a distal end of the split block 114 and 116. The end cap 117 includes a surface feature 119 that is dimensioned and configured to mate with an input wave guide of the antenna structure 80. The end cap 117 thus helps maintain a desired angular orientation of the antenna structure during formation of polarizing structures.

The clamping system 110 further includes hydraulic, pneumatic or other means for urging the male mandrel members 112 radially inwardly relative to the mandrel 12 for deforming the sidewall of the polarizer 82 between respective male 112 and female mandrel members 58 and 60.

Figure 5:
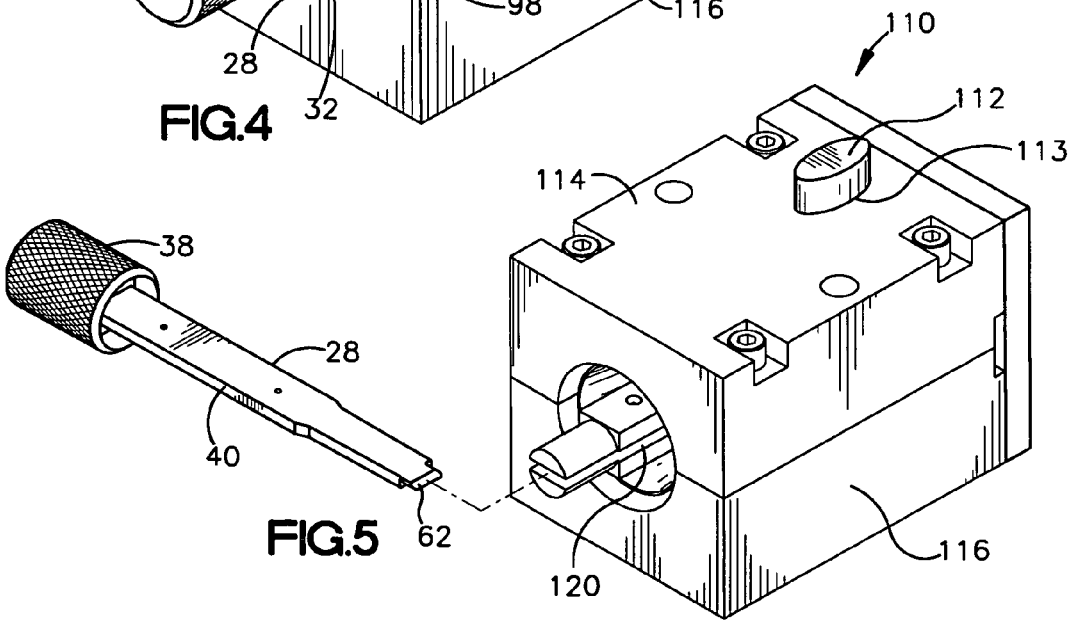
FIG. 5 depicts an example of a mandrel being removed from the clamping system according to an aspect of the present invention.

Referring to FIG. 5, after the male mandrel members 112 have been urged into engagement with the exterior portion of the polarizer to deform the polarizer sidewall between the respective male and female mandrel members, the middle mandrel 28 can be removed from the mandrel assembly 12. By removing the middle mandrel 28, the side mandrels 30 and 32 can be collapsed towards each other into the space 120 provided by the removal of the middle mandrel 28. The space 120, which generally corresponds to the thickness of the rod 40 of the middle mandrel, is sufficient to facilitate the removal of the side mandrels 30 and 32. As an example, the thickness of the middle mandrel 28 should be at least as thick as the combined depth of the female mandrel members 58 and 60.

Those skilled in the art will understand and appreciate that other configurations of a mandrel assembly for providing the corresponding female mandrel members can be implemented in accordance with an aspect of the present invention. For example, the middle mandrel portion can be destructible and removable (in one or more pieces) so as to facilitate removal of the side mandrels 30 and 32. Alternatively, the entire mandrel assembly can be destructible or otherwise disposable to facilitate its removal relative to the antenna structure. However, the multi-piece mandrel assembly 12 shown and described herein provides an economic approach since each of the corresponding mandrel pieces 28, 30 and 32 can be reutilized in subsequent manufacturing processes for additional antennas.

Figure 6:
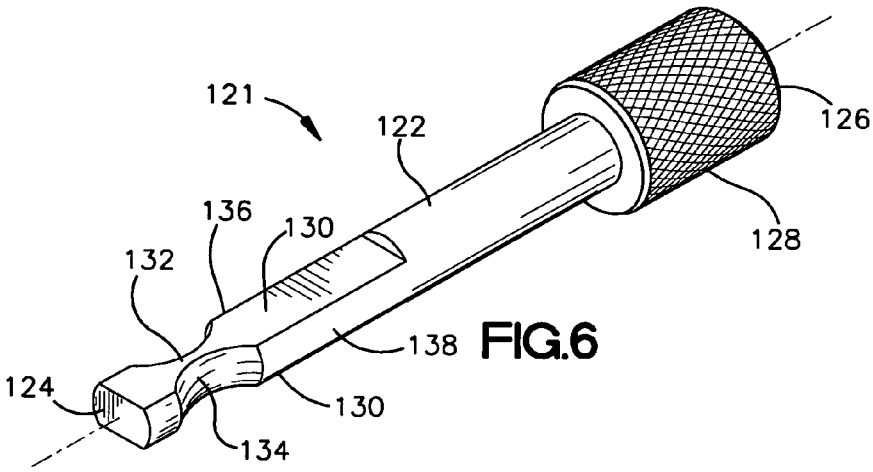
FIG. 6 depicts an example of a single-piece mandrel according to an aspect of the present invention.

FIG. 6 depicts an example of a single-piece mandrel 120 that can be utilized in formation of a polarizing structure of an antenna according to an aspect of the present invention. The mandrel 120 includes an elongated body portion 122 that extends longitudinally between spaced apart ends 124 and 126. A knob or handle 128 is located near the end 126 to facilitate insertion, rotation and removal of the mandrel 120 relative to a polarizer body. A distal end portion of the mandrel (near end 124) has substantially parallel and opposing planar surfaces 130. A pair of opposed side edge portions 136 and 138 extend transversely between the planar surfaces 130.

Female mandrel member 132 and 134 are formed in the respective side edge portions 136 and 138, respectively, spaced a predetermined distance from the end 124. The female mandrel members 132 and 134 are dimensioned and configured according to the desired dimensions and configurations of the polarizing structures to be formed, generally for mating with corresponding male mandrel members (e.g., similar to as shown and described in FIGS. 4 and 5).

In the example of FIG. 6, the female mandrel members 132 and 134 include curved slots, providing a generally hourglass shape at the end 124 of the mandrel 120. The thickness of the mandrel 120 between the opposed surfaces 130 is dimensioned to be approximately less than or equal to the thickness between the radially inner surfaces of the female mandrels 132 and 134. By way of example, the polarizer structures can be formed in the sidewall of the polarizer by movement of corresponding male members in a clamping system (see, e.g., FIG. 5). After the polarizing structure has been formed, the mandrel 120 can be rotated about its axis (e.g., about 90 degrees) and then axially removed from the clamping system. Accordingly, the single-piece mandrel can be reusable for forming additional polarizer structures, such as described herein.

Figure 7:
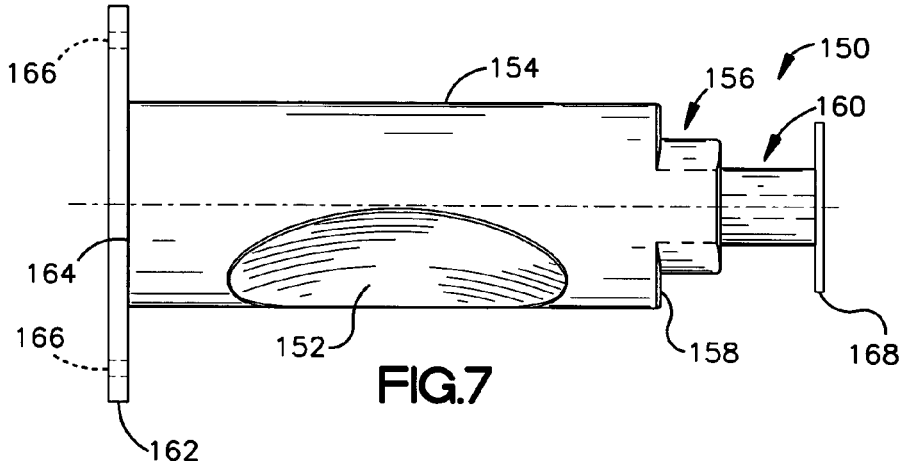
FIG. 7 depicts an example of a polarizer structure that can be fabricated according to an aspect of the present invention.

FIG. 7 depicts an example of an integrated polarizer-transition structure 150. The polarizer-transition structure 150 can be fabricated from a single piece of material (e.g., aluminum 6061 or other electrically conductive materials and coatings) for use in combination with a variety of horn configurations.

The polarizer-transition structure 150 includes a pair of substantially diametrically opposed polarizing structures 152, such as substantially smooth and continuous radially inwardly extensions along a sidewall 154 of the polarizer. Each of the polarizing structures 152 can be implemented as a radial inward deformation in the sidewall 154. Each polarizing structure 152, for example, can be a generally concave (from a perspective external to the polarizer-transition structure) and provide a substantially smooth and continuous radially inward deformation within the sidewall 154 (from a perspective internal to the polarizer-transition structure), such as shown and described herein. Other shapes, configurations or polarizing structures can also be utilized.

The polarizer-transition structure 150 also includes a transition stage 156 at a proximal end 158 thereof. The transition stage 156 can be coupled to or integrally formed with a waveguide input, indicated at 160. Additionally, a flange or other mounting structure (not shown) could be provided at the waveguide input 160 for attaching the structure 150 to a waveguide or a mounting plate (e.g., for a phased array antenna).

The polarizer-transition structure 150 also includes a flange (or other means) 162 for attaching a distal end 164 of the structure to a horn (not shown). The flange 162, for example, includes apertures 166 that can be employed with either bolts or rivets to fasten the polarizer-transition structure 150 to a corresponding flange (or other structure) of the horn.

Figure 8:
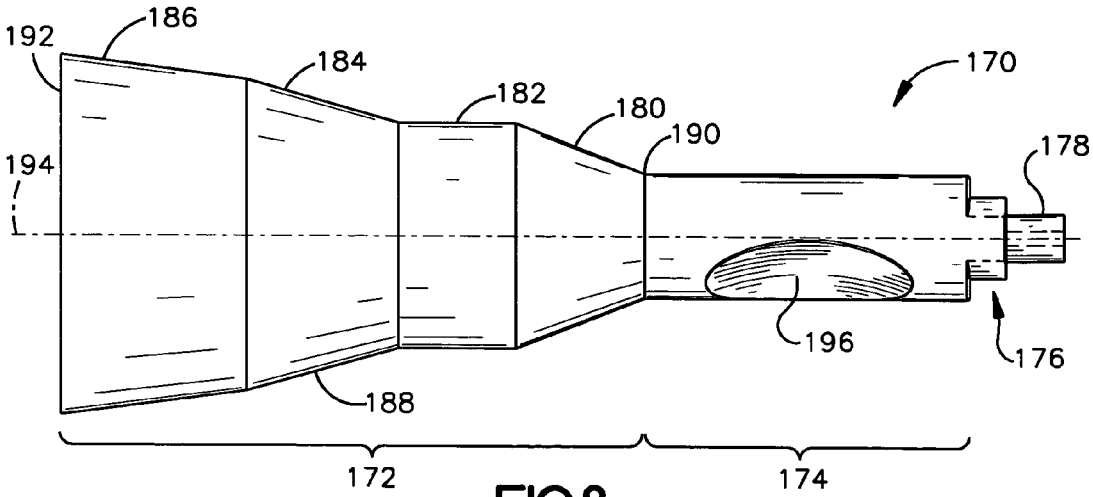
FIG. 8 depicts an example of an integrated horn and polarizer antenna structure that can be fabricated according to an aspect of the present invention.

FIG. 8 depicts an example of a multi-flare horn antenna 170 that can be implemented in accordance with an aspect of the present invention. The antenna 170 includes a horn section 172, a polarizer 174, a transition 176 and a waveguide input 178.

In the example of FIG. 7, the horn 172 is a multi-flare horn that includes four flare sections 180, 182, 184 and 186 (although any number of one or more flare sections could be utilized). The flare sections 180, 182, 184 and 186 collectively define a sidewall 188 of the horn 172, which extends longitudinally between spaced apart ends 190 and 192. Each of the flare sections 180, 182, 184 and 186 can have different flare angles relative to a central axis 194 that extends longitudinally through the horn sidewall 188. An aperture of the horn 172 is provided at the distal end 192 of the horn associated with flare section 186. The proximal end 190 of the horn sidewall 188, corresponding to flare section 180, interfaces with the polarizer 174 to provide a transition region.

The flare angles of the flare sections 180, 182, 184 and 186 determine the operating modes and patterns of radiating waves for the antenna 170. The flare angles can be designed to configure percentages of desired radiation modes as well as control radiation patterns and/or frequency bands capable of being propagated by the antenna 170. The transition section 180 has a corresponding flare angle to provide a desired interface with the polarizer 174. The next section 182 is depicted as a substantially circular cylindrical member that operates to implement phase matching. The other sections 184 and 186 each have flare angles selected to control the modes of radiation and propagation velocities. The flare section 186 also has a diameter configured to provide the aperture at the end 192, which can vary depending on the application and system requirements of the antenna 170.

Those skilled in the art will understand and appreciate various types and configurations of polarizers 174 that can be utilized in conjunction with the multi-flare horn portion 172. For example, the polarizer 174 can include a pair of polarizing structures 196, such as any of the types shown and described herein. The transition stage 176 further can be configured according to the type of waveguide input 178 and the polarization being provided by the polarizer 174.

As described herein, the multi-flare horn design affords a reduced horn length while improving the horn aperture efficiency relative many existing horn designs. By way of example, figure-of-merits of a horn include the aperture efficiency and radiation pattern symmetry. A horn with high aperture efficiency provides desired high antenna gain. A horn with symmetric radiation patterns is desired for circularly polarized electromagnetic field application, because the polarization efficiency is typically high. According to an aspect of the present invention, the antenna 170 can be fabricated with horn 172 having the four flare sections. Advantageously, such an antenna can have a relatively short length (e.g., about 2.4"), high aperture efficiency (e.g., >about 90%), and have good pattern symmetry. Additionally, the simple structure associated with having a substantially smooth interior sidewall 188 further helps reduce the antenna's weight and facilitates its fabrication, as described herein.

As a further example, the horn 172 can be formed as an integrated structure with the polarizer 174, such as by machining or milling the integrated structure from a single piece of a material, such as aluminum. Alternatively, the horn 172 could be attached to the polarizer 174, such as by fasteners or clamping devices. Those skilled in the art will further understand and appreciate that the transverse cross-section of the horn 172 can also have a variety of shapes, which can vary depending on system requirements. For instance, the horn or flare sections thereof can have a circular cross-sectional shape, an elliptical cross-sectional shape, a rectangular cross-sectional shape, a pyramidal shape, a hexagonal cross-sectional shape, an octagonal cross-sectional shape, a continuous bell shape, etc. Additionally, while a substantially smooth and continuous interior sidewall will facilitate fabrication, the horn 172 can also be provided with discontinuities, such as corrugations, choke sections or other features formed along the interior sidewall of the horn.

Figure 9:
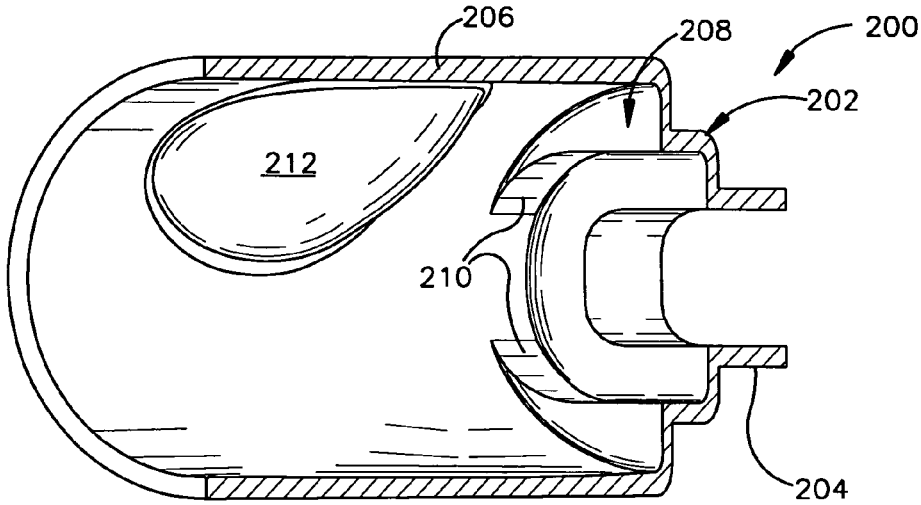
FIG. 9 depicts a partial cross-sectional view of a transition stage of an integrated polarizer structure according to an aspect of the present invention.

FIG. 9 depicts a cross-sectional view of part of a polarizer-transition assembly 200 to better illustrate interior features of an example transition stage 202 that can be implemented according to an aspect of the present invention. The transition stage 202 provides an interface between a waveguide 204 and a polarizer section 206 of the assembly 200. By way of further example, RF power output from a solid state amplifier (not shown) can be provided to the rectangular waveguide input 204, and the polarizer 206 can have a circular cross section. Accordingly, the assembly 200 includes the transition stage 202 to transport RF output power from the rectangular waveguide to the polarizer 206.

The figure-of-merit of the transition is the return loss, which corresponds to a measure of the amount of RF power that reflects back toward the source. A typical transition is a tapered transition such that its cross section changes gradually to mate the two interfaces (the polarizer 206 and waveguide 204). A tapered transition, however, usually requires a length of one wavelength or longer to achieve suitable performance. In the example of FIG. 9, by contrast, the transition stage 202 is implemented as a quarter-wavelength single stage transformer 208. This single stage transformer 208 is configured as a single step to substantially match the impedances of the two different interfaces. The single stage transformer 208 has the advantages of short length and excellent return loss (e.g., less than −25 dB). The transformer 208 design can also tolerate rounded corners, indicated at 210, without causing a significant reduction in performance. Thus, standard cutting tools can be employed to mill out the step transition shape during single-piece fabrication. For example, when combined with a horn structure, such as shown and described herein, the step transformer can be machined from the aperture side of horn. Such machining can be further facilitated, for instance, by implementing the horn as multi-flare horn having substantially smooth sidewalls and a corresponding polarizer (see, e.g., FIGS. 1 and 4). This is because such a multi-flare horn design can be implemented with a sufficiently reduced length (compared to many existing designs) such that standard tooling can be employed to form the transition. Usually, although not necessarily, the transition stage would be machined prior to forming the polarizing structure 212 of the polarizer 206.

FIG. 10 depicts an example of a phased array antenna 220 that can be constructed from a plurality of antennas 222 according to an aspect of the present invention. The antennas 222 are shown attached to a mounting plate 224. By fabricating the antennas 222 using single piece construction and with substantially smooth interior portions, as described herein, each antenna can have a decreased weight when compared to many existing antenna designs. As a result, the weight of the phased array antenna 220 can be further reduced by an amount proportional to the number of antennas 222 (e.g., often including hundreds or thousands of antennas).

When combining feed components into an integrated assembly, the usual approach is to fabricate separate pieces and fasten the sections together using either bolts or rivets. This typical approach introduces a pair of flanges and clamping hardware at each interface, resulting in added weight. Thus, it is undesirable in satellite antenna applications. In contrast, a single-piece antenna structure, according to an aspect of the present invention, is highly desirable, as it offers minimal weight, reduced assembly effort and low cost when compared to many existing approaches.

Figure 11:
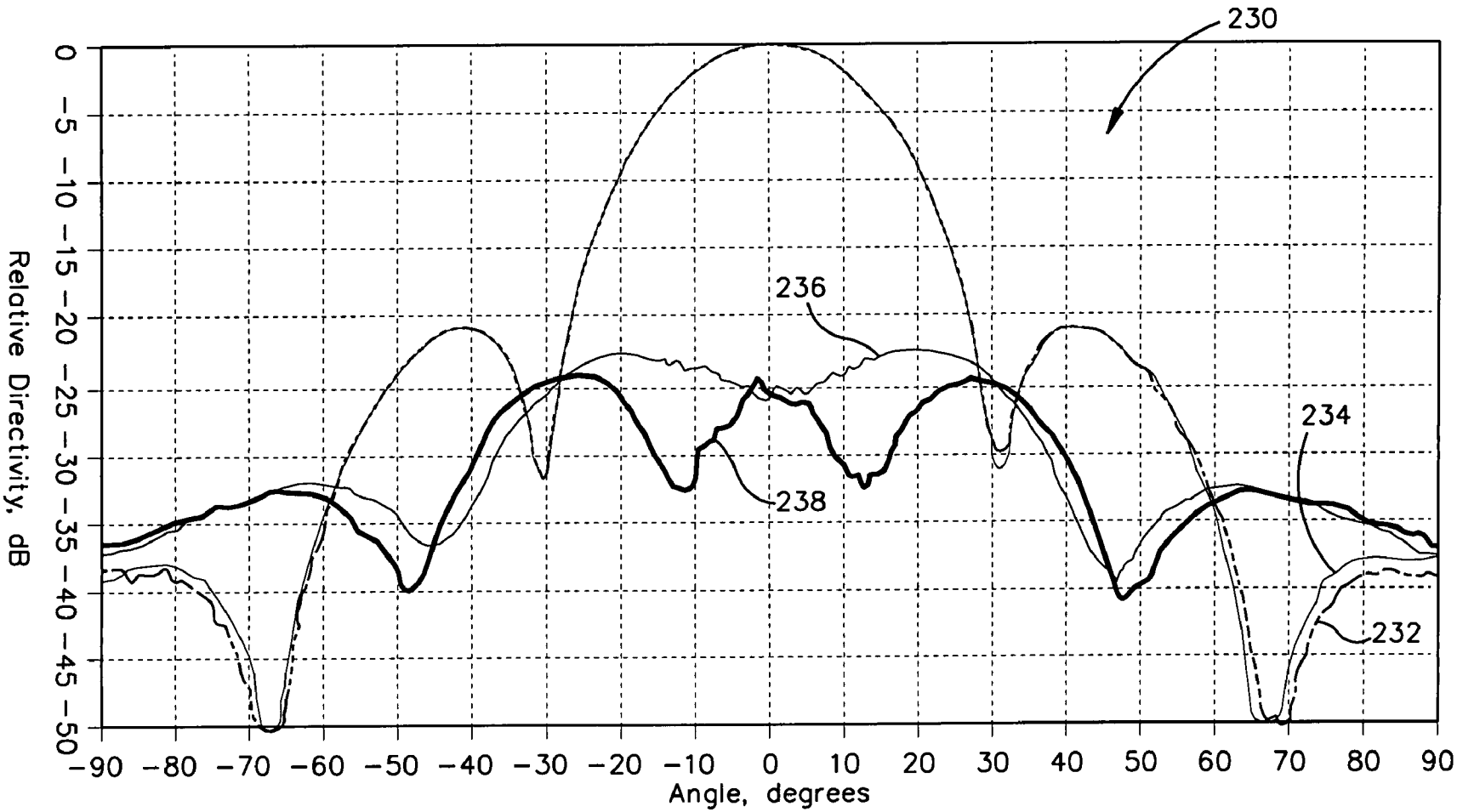
FIG. 11 is a graph depicting an example of typical radiation patterns for an antenna according to an aspect of the present invention.

FIG. 11 depicts a graph 230 of relative directivity (in dB) versus angle (in degrees) representing a typical measured radiation pattern for an antenna constructed according to an aspect of the present invention. The graph 230 shows two principal polarization (RHCP) patterns, the E-plane 232 and the H-plane 234. The circularly polarized fields from this horn antenna provide symmetrical patterns at E-plane and H-plane, resulting in overlapping principal polarization (RHCP) patterns, as shown in FIG. 11. The two cross polarization (LHCP) patterns, indicated at 236 and 238, are about −25 dB level below the peak. Thus, from the graph 230, it is shown that the antenna AR<0.9 dB, a desirable characteristic for a circularly polarized horn antenna.

Figure 12:
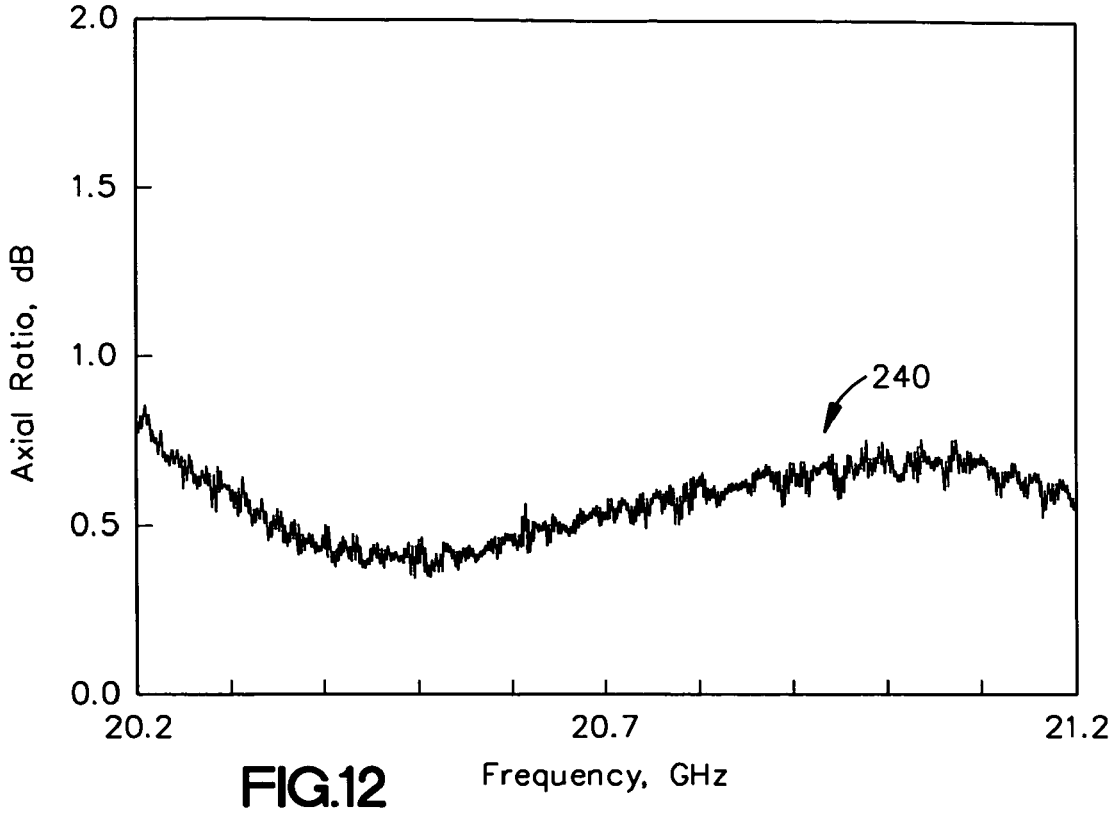
FIG. 12 is a graph depicting measured axial ratio as a function of frequency for an antenna according to an aspect of the present invention.
Figure 13:
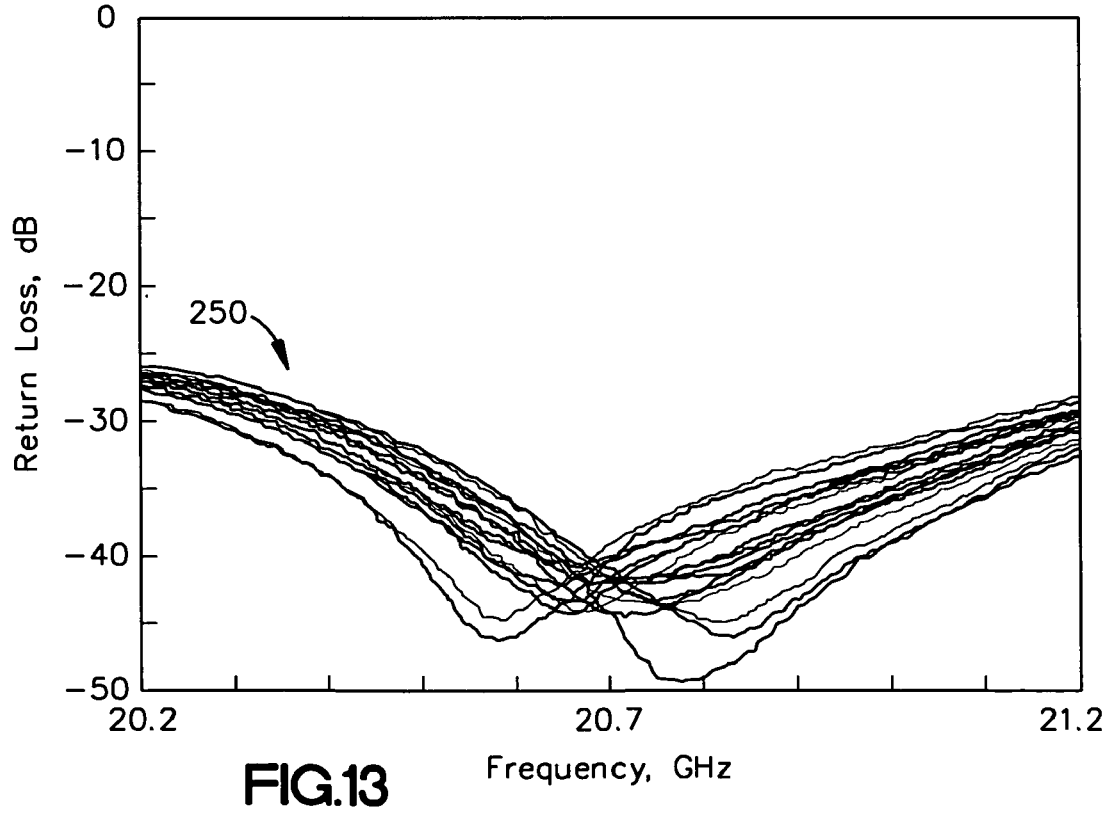
FIG. 13 is a graph depicting a measured input return loss as a function of frequency for an antenna according to an aspect of the present invention.

FIG. 12 depicts a graph 240 of AR (in dB) as a function of frequency (in GHz), representing the frequency sweep of AR performance for an antenna implemented according to an aspect of the present invention. In the frequency band of interest, the AR is below 0.9 dB. Another graph 250, in FIG. 13, provides plots of input return loss shown for a plurality of horn antennas implemented in accordance with an aspect of the present invention. The return loss of the antennas value is below approximately −25 dB over the frequency band of interest. Thus, this horn antenna design provides very good impedance match to the subsequent components in the system. A conservative estimate of the insertion loss for such antennas is low, such as about −0.1 dB. The results for the return loss demonstrate the excellent repeatability of the electrical performance for antennas fabricated according to an aspect of the present invention. It will be understood and appreciated that the antenna can be easily integrated with a solid state power amplifier module for a transmit phased array application, or with a low noise amplifier module for a receive phased array application.

In view of the forgoing, with the length reduction on the horn, polarizer and transition sections relative to many conventional antenna designs, a compact horn antenna design can be provided at a reduced cost and provide high performance over a broad range of frequencies. The antenna design is readily scalable to accommodate different aperture sizes or different frequency bands. It is expected that the design can provide high performances at high frequencies, including up to and beyond 60 GHz.

By way of further example, an antenna having a total length of about 4.1" can be provided that provides comparable performance to an antenna having typically 8" feed assembly, a considerable reduction in length. Additionally, as described herein, the polarization can be easily converted from RHCP to LHCP by modifying the polarizer structure. The internal structure of this horn antenna design can be very simple (e.g., substantially smooth and continuous interior sidewalls), enabling low cost, single-piece fabrication. This compact horn antenna design is very suitable for phased array antennas in satellite communications (see, e.g., FIG. 10).

Comparing the antenna 170 design of FIG. 8 with comparable performing antennas, height and weight parameters can be reduced by 50% or more. Significantly, the cost of making each antenna, according to an aspect of the present invention, can be reduced by approximately 95%. This dramatic cost reduction can be achieved when the antenna is fabricated from the preferred material in the industry, namely, aluminum. The consistency in the measured performance of this design allows for margin to be given back to other system components.

Figure 14:
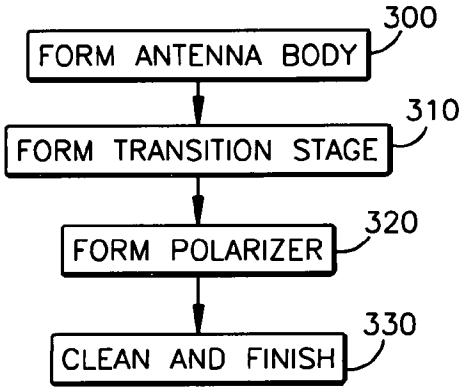
FIG. 14 is a flow diagram depicting a method for making an antenna structure according to an aspect of the present invention.

FIG. 14 is a flow diagram depicting a method that can be employed to make an antenna according to an aspect of the present invention. The method begins at 300 by forming an antenna body. The body can include a horn portion and a polarizer portion. The antenna body can be formed, for example, as an integral structure by machining the body from a block of a suitable material (e.g., aluminum) or by molding the body from a suitable material (e.g., aluminum or plastic materials). According to an aspect of the present invention, the horn portion includes a plurality of horn flare sections having different flare angles (see, e.g., four different flare angles in FIG. 8). The polarizer portion, which can be integral with the horn portion, has a generally cylindrical sidewall portion. The interior of the antenna body can be substantially smooth.

By way of example, typical single-piece manufacturing processes, which can be utilized to form the antenna body, include machining, casting, electroforming and hipping, injection molding among others. The hipping process has the drawbacks of high cost, low yield and product variation. The electroforming process has the drawbacks of high cost and heavy products (as copper is the preferred material in the electroforming process). Because of the simple internal structure of the antenna, a thin-wall, single-piece machining process can be employed to deliver low cost, precise, repeatable products. For instance, the antenna body (see e.g., FIG. 8) can be formed by machining a desired structure from a durable material, such as 6061 aluminum.

At 310, a transition stage is formed at. a proximal end of the body (at the opposed end from the horn portion). The transition stage, for example, can be fabricated as a single step transition to provide an interface between a rectangular waveguide and a circular polarizer, such as described herein. The single step transition can be machined in the proximal end of the polarizer portion of the antenna body, such as by inserting appropriate tooling through the antenna aperture and machining the desired transition stage (see, e.g., FIG. 9) at the opposite end.

At 320, a polarizer is formed in the polarizer portion of the antenna body. The polarizer can be formed by deforming a sidewall of the polarizer portion, as described herein. After the polarizer is formed, at 330, the resulting antenna structure can be cleaned and chemically treated to finish the manufacture process.

Figure 15:
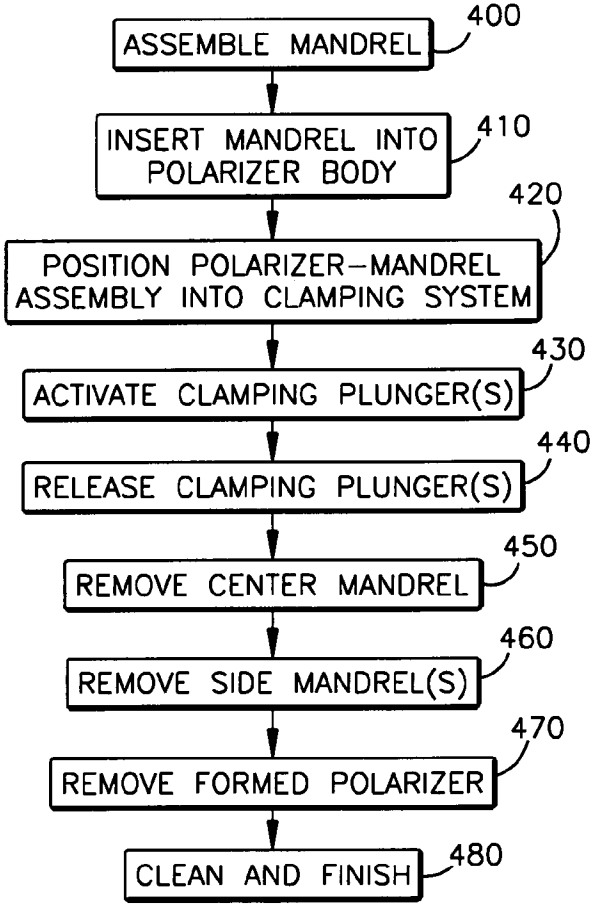
FIG. 15 is a flow diagram depicting an example of another method for making an antenna structure according to an aspect of the present invention.

FIG. 15 is a flow diagram depicting another method that can be utilized for making an antenna structure according to an aspect of the present invention. In particular, the method of claim 14 can be utilized for forming a polarizer for an antenna. The polarizer can be formed as an integral structure with a horn body and transition stage or, alternatively, the polarizer can be formed separately.

The method of FIG. 15 begins at 400 in which a multi-piece mandrel is assembled. The mandrel, for example, can be implemented as a three-piece mandrel having a pair of side mandrels with female mandrel members at distal ends thereof and a middle mandrel member that can be sandwiched between the side mandrels. At 410, after assembling the mandrel (400), the assembled mandrel is inserted into a polarizer body. The polarizer body, for example, includes an elongated, generally cylindrical, sidewall portion into which one or more polarizing structures are to be formed. The angular orientation of the mandrel relative to the polarizer can be controlled to position the female mandrel members of the assembled mandrel at dire positions along the sidewall of the polarizer body.

With the mandrel inserted in the polarizer body, the assembly defines a polarizer-mandrel assembly. At 420, the polarizer-mandrel assembly is positioned into a clamping system. For example, the clamping system includes a holder configured to receive the polarizer-mandrel assembly in a desired, substantially fixed position, so that one or more corresponding male mandrel members can be aligned for movement relative to the mandrel located within the polarizer body. The clamping system includes one or more plungers or other movable parts operative to move the male mandrel members.

At 430, the clamping plungers are activated. The activation of the clamping plungers results in corresponding radial movement of the male mandrel members relative to the female mandrel members that are held fixed relative to the polarizer. As an example, the male mandrel members can be moved radially inwardly toward each other to deform the sidewall of the polarizer body according to the shapes provided by the male and female mandrel members. After the sidewall of the polarizer body has been deformed in a desired manner, at 440 the clamping plungers can be released relative to the polarizer body.

At this stage, the deformed sidewalls substantially engage the female mandrel members, thereby holding the mandrel within the polarizer body. At 450, a central mandrel is removed to facilitate removal of the remaining portions of the mandrel. The central mandrel can be removed, for example, to provide a space between the side mandrels that allows the side mandrels to move toward each other and away from the deformed sidewall of the polarizer body. At 460, the side mandrels can then be removed from the polarizer body. At 470, the formed polarizer can also be removed from the clamping system. At 480, the resulting polarizer structure (or antenna structure when formed as an integral structure) can be cleaned and finished. It will be appreciated that the order of the process can be modified without departing from the inventive concepts described herein.

Figure 16:
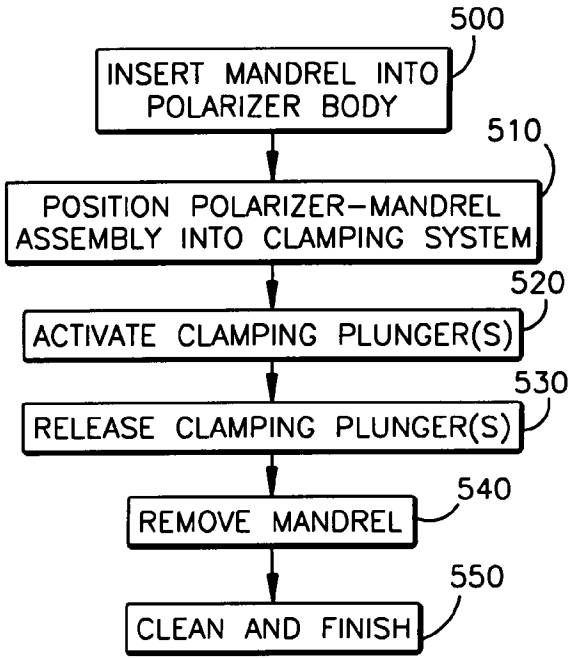
FIG. 16 is a flow diagram depicting yet another example of a method for making an antenna structure according to an aspect of the present invention.

FIG. 16 depicts yet another example of a method that can be utilized to form an antenna structure in accordance with an aspect of the present invention. The method begins at 500 in which a mandrel is inserted into the polarizer body. The mandrel includes one or more female mandrel members, such as a concave feature formed along the surface of the mandrel. The concave feature can be dimensioned and configured according to design specification, such as the size of antenna, the frequency bands for the antenna structure, as well as the type of polarization desired. As one example, the concave feature can have a substantially smooth and continuous sidewall and be configured to have dual radii, such as to provide a semi-torus or semi-ellipsoidal shape.

At 510, the polarizer-mandrel assembly is positioned into a clamping system. The clamping system provides a structure to hold the polarizer body in a generally fixed position to enable one or more corresponding male mandrel members to move relative to the female mandrel members for forming the polarizing structure or structures. At 520, one or more clamping plungers are activated to move the male mandrel members in the desired direction relative to the female mandrel members. As a result of such movement, the sidewall of the polarizer body is deformed according to the dimensions and configuration of the male mandrel members and to the female mandrel members. For example, the male mandrel members can include an end surface dimensioned and configured to be received in the female mandrel members. The respective surfaces can be smooth or include features thereon.

After the sidewall of the polarizer body has been deformed in a desired manner, at 530, the clamping plungers can be released. After the clamping plungers are released, at 540, the mandrel can be removed from the polarizer body. The mandrel can be removed at 540 since at least a portion of the mandrel is collapsible in a manner that enables the female mandrel members to be removed axially from within the deformed polarizer body. Such collapsing or deformation can be implemented, for example, by deploying destructible mandrels, partially destructible mandrels, or multi-piece mandrels that can be removed in sections. After the mandrels have been removed, the resulting formed polarizer can be cleaned and finished.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A method for making a feed structure for an antenna, comprising:

providing a polarizer body having a sidewall extending longitudinally between spaced apart ends;

deforming a portion of the polarizer sidewall to provide at least one polarizing structure that extends inwardly along an interior of the polarizer sidewall relative to adjacent portions of the polarizer sidewall; and forming a horn body to extend from a proximal one of the spaced apart ends of the polarizer sidewall, the polarizer body, the transition stage and the horn body being integrally formed from a single piece of material, wherein the horn body further comprises a sidewall having a plurality of flare sections, at least some of the flare sections having different flare angles.

2. A method for making a feed structure for an antenna, comprising:

providing a polarizer body having a sidewall extending longitudinally between spaced apart ends; and deforming a portion of the polarizer sidewall to provide at least one polarizing structure that extends inwardly along an interior of the polarizer sidewall relative to adjacent portions of the polarizer sidewall, wherein the deforming further comprises urging at least one mandrel to engage the portion of the polarizer sidewall to implement the deformation thereof and thereby form the polarizing structure.

3. The method of claim 2, wherein the at least one mandrel further comprising a pair of mandrels, the deforming further comprising:

positioning the pair of mandrels in a substantially diametrically opposed relationship relative to an exterior of the polarizer sidewall; and urging the pair of mandrels into the polarizer sidewall to form a pair of generally opposed polarizing structures that extend inwardly along the interior of the polarizer sidewall.

4. The method of claim 3, wherein the pair of mandrels comprise male mandrel members, the method further comprising inserting an internal mandrel having female mandrel members configured to mate with the male mandrel members to facilitate forming the pair of opposed polarizing structures.

5. A method for making a feed structure for an antenna, comprising:

providing a polarizer body having a sidewall extending longitudinally between spaced apart ends; and deforming a portion of the polarizer sidewall to provide at least one polarizing structure that extends inwardly along an interior of the polarizer sidewall relative to adjacent portions of the polarizer sidewall;

forming a transition stage near a distal one of the spaced apart ends of the polarizer sidewall, wherein the formation of the transition stage further comprises:

inserting at least one tool into the polarizer through an aperture at a proximal one of the spaced apart ends of the polarizer sidewall; and machining the transition stage with the at least one tool.

6. The method of claim 5, wherein the formation of the transition stage further comprises forming the transition stage to include a single step transition configured to provide an interface between the polarizer body and an associated waveguide.

7. A method for making a feed structure for an antenna, comprising:

providing a polarizer body having a sidewall extending longitudinally between spaced apart ends; and deforming a portion of the polarizer sidewall to provide at least one polarizing structure that extends inwardly along an interior of the polarizer sidewall relative to adjacent portions of the polarizer sidewall, wherein the at least one polarizing structure comprises one of a generally semi-torus, semi-ellipsoidal or semi-spheroidal inward extension of the portion of the polarizer sidewall.

8. The method of claim 7, wherein the interior of the polarizer sidewall, including the at least one polarizing structure thereof, provides a substantially smooth and continuous surface between the spaced apart ends of the polarizer sidewall.

* * * * *